US009328545B1

(12) United States Patent
Ng

(10) Patent No.: US 9,328,545 B1
(45) Date of Patent: May 3, 2016

(54) BLIND HINGE STRUCTURE USED FOR FURNITURE

(71) Applicant: GUANGDONG TAIMING METAL PRODUCTS CO. LTD, Foshan (CN)

(72) Inventor: Tai Wai Ng, Foshan (CN)

(73) Assignee: Guangdong Taiming Metal Products Co. Ltd., Foshan (CN)

( * ) Notice: Subject to any disclaimer, the term of this patent is extended or adjusted under 35 U.S.C. 154(b) by 0 days.

(21) Appl. No.: 14/601,873

(22) Filed: Jan. 21, 2015

(30) Foreign Application Priority Data

Jan. 16, 2015 (CN) ..... 2015 2 0033842

(51) Int. Cl.

| | |
|---|---|
| ***E05F 1/08*** | (2006.01) |
| ***E05D 7/04*** | (2006.01) |
| ***E05D 3/02*** | (2006.01) |
| ***E05F 1/12*** | (2006.01) |

(52) U.S. Cl.
CPC ..... *E05D 7/0423* (2013.01); *E05D 3/02* (2013.01); *E05F 1/1207* (2013.01); *E05D 2007/0476* (2013.01)

(58) Field of Classification Search
CPC ..... E05Y 2900/20; E05Y 2900/202; E05Y 2900/204; E05Y 2900/208; E05Y 2201/20; E05Y 2201/21; E05Y 2201/256; E05F 5/006; E05F 5/02; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029; Y10T 16/5321; Y10T 16/5322; Y10T 16/53225
See application file for complete search history.

(56) References Cited

U.S. PATENT DOCUMENTS

| | | | | |
|---|---|---|---|---|
| 5,920,958 | A * | 7/1999 | Domenig | E05D 7/0423 16/237 |
| 6,647,591 | B1 * | 11/2003 | Domenig | E05D 7/0415 16/238 |
| 6,845,544 | B2 * | 1/2005 | Hofer | E05D 7/0415 16/242 |
| 6,918,158 | B2 * | 7/2005 | Isele | E05D 7/0415 16/235 |
| 7,117,561 | B1 * | 10/2006 | Domenig | E05D 7/0407 16/236 |
| 7,213,300 | B1 * | 5/2007 | Domenig | E05D 7/04 16/236 |
| 7,231,691 | B1 * | 6/2007 | Domenig | E05D 7/0407 16/236 |
| 7,509,708 | B1 * | 3/2009 | Radke | E05D 7/0415 16/237 |

(Continued)

FOREIGN PATENT DOCUMENTS

| | | | |
|---|---|---|---|
| CN | 202431094 U | * | 9/2012 |
| CN | 103590693 A | * | 2/2014 |

*Primary Examiner* — Chuck Mah
(74) *Attorney, Agent, or Firm* — Maier & Maier, PLLC

(57) ABSTRACT

A blind hinge structure used for furniture, comprising a movable cup holder provided on the furniture door body, an adjusting base provided on the furniture body, a rotary arm connected between the movable cup holder and the adjusting base as well as an elastic element designed to generate opening/closing acting force on the movable cup holder; wherein the adjusting base is designed to realize three-dimensional or two-dimensional adjustment to the hinge; a convex step used to support the elastic member is integrally formed on the bottom wall of the movable cup holder; the elastic member is a torsion spring, with its section on at least one of its end parts being square or circular. The present utility model enables the structure among the rotary arm, the adjusting base and the adjusting components to have higher firmness and even compact assembly, improves strength and extends the service life.

6 Claims, 7 Drawing Sheets

(56) References Cited

U.S. PATENT DOCUMENTS 7,516,516 B2 * 4/2009 Wu ..... E05D 7/0415 16/238
2004/0006846 A1 * 1/2004 Rupprechter ..... E05D 7/0415 16/235
2004/0163211 A1 * 8/2004 Rucker ..... E05D 7/0415 16/235
2006/0137139 A1 * 6/2006 Wu ..... E05D 7/0415 16/236
2006/0143859 A1 * 7/2006 Wu ..... E05D 7/0415 16/242
2007/0289093 A1 * 12/2007 Nallamottu ..... E05D 7/0407 16/236
2008/0271290 A1 * 11/2008 Chen ..... E05D 7/04 16/238
2008/0271291 A1 * 11/2008 Chen ..... E05D 7/0407 16/238
2008/0271292 A1 * 11/2008 Lowe ..... E05D 7/0407 16/238
2012/0167342 A1 * 7/2012 Wu ..... E05D 7/0415 16/239
2012/0167343 A1 * 7/2012 Wu ..... E05D 11/1014 16/277
2013/0167323 A1 * 7/2013 Brunnmayr ..... E05D 11/1014 16/50
2013/0239363 A1 * 9/2013 Apur ..... E05F 5/006 16/50
2013/0305487 A1 * 11/2013 Hagspiel ..... E05D 7/0407 16/235
2015/0135479 A1 * 5/2015 Salice ..... E05D 5/0276 16/236

* cited by examiner

BLIND HINGE STRUCTURE USED FOR FURNITURE

FIELD OF THE INVENTION

The present utility model relates to a hinge structure, in particular to a blind hinge structure used for furniture.

BACKGROUND OF THE PRIOR ART

On May 17, 2006, Chinese patent (patent document number: CN2780937Y) disclosed a blind hinge for furniture door which can realize three-dimensional direction adjustment, comprising a movable base which can be fixed on the door body, an adjustable base which can be fixed on the door frame and a rotary arm connected between the movable base and the adjustable base, wherein the adjustable base comprises a base plate which can be fixed on the door frame, a middle plate which is designed to slide up/down on the base plate as well as upper layer adjusting plate three-layer pate components which are designed to slide forward/backward on the middle plate, namely the base plate on the door frame is designed as three-layer plate part structure, where the middle plate is formed through alloy casting and is riveted with the lower-layer adjusting plate after re-extrusion. Although the said invention has simple production process, this production process brings some hidden troubles for the quality of hinge. After re-extrusion of alloy casting, changes will take place in the internal structure of the material, such as looser structure and cracking. So, it is difficult for the production process to ensure the reliability of riveting between alloy casting and upper layer regulating plate, leading to unsatisfactory strength of hinge, easy drop of door plate, short service life, complicated structure, many required assembly parts as well as high manufacturing costs. Therefore, it is necessary to make further improvement.

DESCRIPTION OF UTILITY MODEL

It is the technical objective of the present utility model to provide a blind hinge structure used for furniture, which is featured by simple and reasonable structure, low manufacturing cost, easy production and realization, compact connection between members, long service life, smooth process of opening/closing, low noise, esthetic appearance and good practicability, so as to overcome the deficiencies in the prior art.

A blind hinge structure used for furniture designed according to this objective, comprising a movable cup holder provided on the furniture door body, an adjusting base provided on the furniture body, a rotary arm connected between the movable cup holder and the adjusting base as well as an elastic element designed to generate opening/closing acting force on the movable cup holder; characterized in that, the adjusting base is designed to realize three-dimensional or two-dimensional adjustment to the hinge; a convex step used to support the elastic member is integrally formed on the bottom walls on both sides of the movable cup holder; the elastic member is a torsion spring, with its section on at least one of its end parts being square or circular.

In the first embodiment, the adjusting base comprises a rotary arm, a movable plate and a base plate; the movable plate is movably placed between the rotary arm and the base plate; the rotary arm is connected with the movable plate through the adjusting screw and the first eccentric adjustment river, and the movable plate is connected with the base plate through the second eccentric adjustment rivet, so that the three-dimensional adjustment to the furniture door body is realized.

The adjusting screw, the first eccentric adjustment rivet and the second eccentric adjustment rivet are arranged in triangle form on the whole; the adjusting screw passes through the first adjusting hole on the rotary arm and is buckled in the open slot on the movable plate; the first eccentric adjustment rivet passes through the second adjusting hole on the rotary arm and is assembled on an assembly hole on the movable plate; the second eccentric adjustment rivet passes through the third adjusting hole on the movable plate and is assembled on the mating hole on the base plate; a fixed plate is provided at the bottom of the base plate and is positioned in coordination with the first eccentric adjustment rivet and/or the second eccentric adjustment rivet.

Both sides of the rotary arm are bent downwards to form a groove, both sides of the movable plate are correspondingly bent upwards to form a strip-type convex part and are assembled in the groove, and the movable plate has a certain working space in the groove; a guide slot used to limit the backward/forward movement of the movable plate is provided at the front end and/or rear end of the base plate; the front end and/or rear end of the movable plate is slideably placed in the guide slot.

In the second embodiment, the adjusting base comprises a rotary arm and a movable plate; the rotary arm and the movable plate are connected through the adjusting screw and the first eccentric adjustment rivet.

The adjusting screw passes through the first adjusting hole on the rotary arm and is buckled in the open slot on the movable plate; the first eccentric adjustment rivet passes through the second adjusting hole on the rotary arm and is assembled on the assembly hole on the movable plate; a fixed part is provided at the bottom of the movable plate and is positioned in coordination with the first eccentric adjustment rivet.

Both sides of the rotary arm are bent downwards to form a groove, a convex part is provided on the movable plate and is assembled in coordination in the groove; the movable plate has a certain working space in the groove; two corners at front end and/or rear end of the movable plate are bent downwards to form a claw.

All the said embodiments have the following structure, wherein the step and the movable cup holder are integrally formed through stamping; the step is so designed that single side is torn open or any of four sides is not torn open, namely the step and the movable cup holder are mutually connected through 3 sides or 4 sides.

The elastic element is composed of two torsion springs in mirror symmetry, which are respectively mounted in the sags on both sides at the bottom of movable cup holder; a straight end and a bent end are provided on the torsion spring, wherein the straight end extends into the cup body of the movable cup holder and is elastically pressed on the rotary arm; the bent end is supported on the step; when the step is so designed that single side is torn open, the bent end of the torsion spring is inserted into the hole formed through tearing; when the step is so designed that any of four sides is not torn open, the bent end of the torsion spring abuts on the sides of the step.

One end of the rotary arm extends into the cup body of the movable cup holder and is rotatablely connected with the movable cup holder through a pin shaft; arc-shaped surfaces are provided on both sides of the end where the rotary arm extends into the cup body of the movable cup holder, and the straight end of the torsion spring abuts on the arc-shaped surfaces.

The present utility model enables the structure among the rotary arm, the adjusting base and the adjusting components to have higher firmness and even compact assembly, thus improves structure strength of blind hinge used for furniture and extends its service life; since the elastic element is directly provided on the gap of the movable cup holder, there is no need for any component, the manufacturing process is further simplified, the cost is reduced; in addition, an external member is also provided on the elastic element, the friction loss between the elastic element and the movable cup holder is reduced in the process of opening/closing of hinge, so that the loss of elastic element is reduced, the noise generated due to friction between the elastic element and the movable cup holder is also reduced, and the opening/closing of hinge becomes even smooth with lower noise. The present utility model is featured by simple and reasonable structure, reliable performance, low manufacturing cost, easy production and realization, compact connection between members, long service life, smooth opening/closing process, low noise, esthetic appearance and high practicability.

DESCRIPTION OF ATTACHED DRAWINGS

DETAILED DESCRIPTION OF PREFERRED EMBODIMENTS

Further detailed description of the present utility model is provided with reference to specific embodiments in combination with attached drawings.

The First Embodiment

Figure 1:
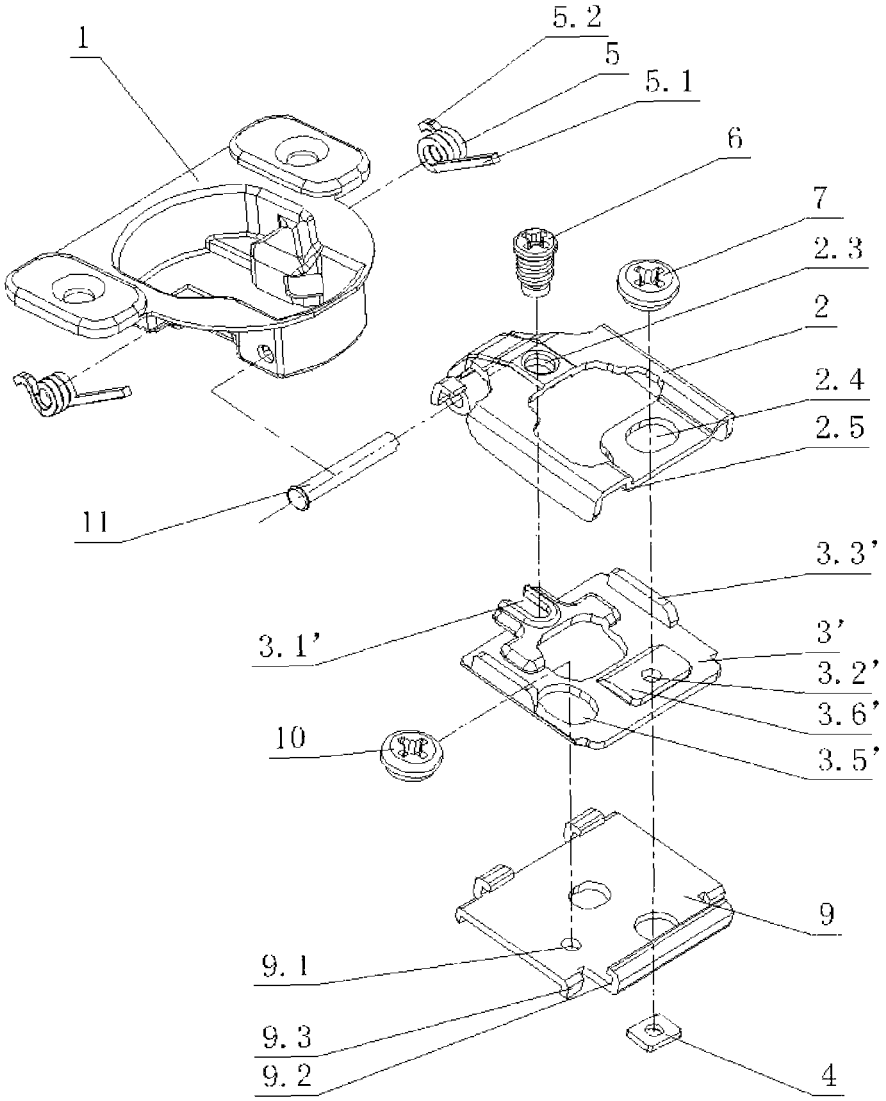
FIG. 1 is the breakdown structure diagram of the first embodiment of the present utility model.
Figure 2:
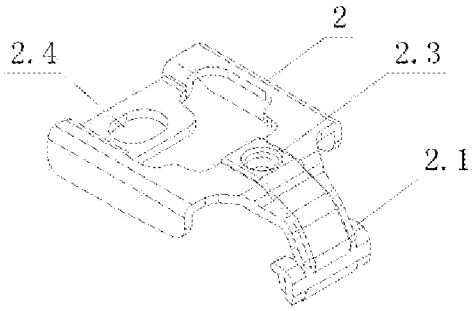
FIG. 2 is the breakdown drawing of the movable cup holder and the elastic element in the first embodiment of the present utility model.
Figure 3:
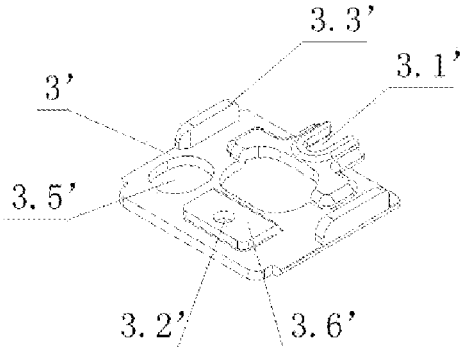
FIG. 3 is the assembly diagram of the movable cup holder and the elastic element in the first embodiment of the present utility model.
Figure 4:
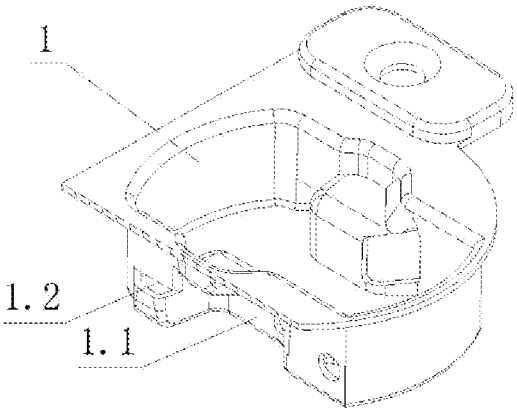
FIG. 4 is the three-dimensional structure diagram of the movable cup holder in the first embodiment of the present utility model.
Figure 5:
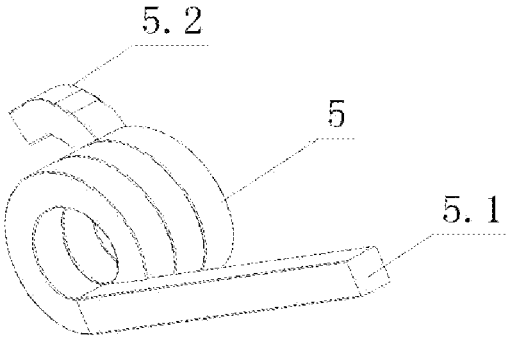
FIG. 5 is the three-dimensional structure diagram of the elastic element in the first embodiment of the present utility model.

As shown in FIG. 1, the blind hinge used for furniture comprises a movable cup holder 1 provided on the furniture door body, an adjusting base provided on the furniture body, a rotary arm 2 connected between the movable cup holder 1 and the adjusting base as well as an elastic element designed to generate opening/closing acting force on the movable cup holder 1, wherein the adjusting base is designed to realize three-dimensional adjustment to the hinge; a convex step 1.2 used to support the elastic element is integrally formed on the bottom walls on both sides of the movable cup holder 1; the elastic element is the torsion spring 5, with the section at least one of its end parts being square or circular.

Specifically, the adjusting base comprises a rotary arm 2, a movable plate 3 ' and a base plate 9, wherein the movable plate 3 is movably placed between the rotary arm 2 and the base plate 9; the rotary arm 2 is connected with the movable plate 3' through the adjusting screw 6 and the first eccentric adjustment rivet 7, the movable plate 3' is connected with the base plate 9 through the second eccentric adjustment rivet 10, so that the three-dimensional adjustment to the furniture door body is realized. The adjusting screw 6, the first eccentric adjustment rivet 7 and the second eccentric adjustment rivet 10 are arranged in triangle form on the whole; the adjusting screw 6 passes through the first adjusting hole 2.3 with thread and is buckled in the open slot 3.1' on the movable plate 3'; the spacing between the rotary arm 2 and the movable plate 3' can be adjusted by rotating the adjusting screw 6, so that the overall height adjustment is realized. The first eccentric adjustment rivet 7 passes through a capsule-shaped second adjusting hole 2.4 on the rotary arm 2 and is then assembled on an assembly hole 3.2' on the movable plate 3'; using the eccentric characteristic of the first eccentric adjustment rivet 7, it is feasible to adjust the forward/backward movement of the movable plate 3' relative to the rotary arm 2; the second eccentric adjustment rivet 10 passes through a capsule-shaped third adjusting hole 3.5 on the movable plate 3' and is assembled into the mating hole 9.1 on the base plate 9; using the eccentric characteristic of the second eccentric adjustment rivet 10, it is feasible to adjust the left/right movement of the rotary arm 2 and the movable plate 3'. Furthermore, a fixed plate 4 is provided at the bottom of the base plate 9 and is positioned in coordination with the first eccentric adjustment rivet 7.

Figure 6:
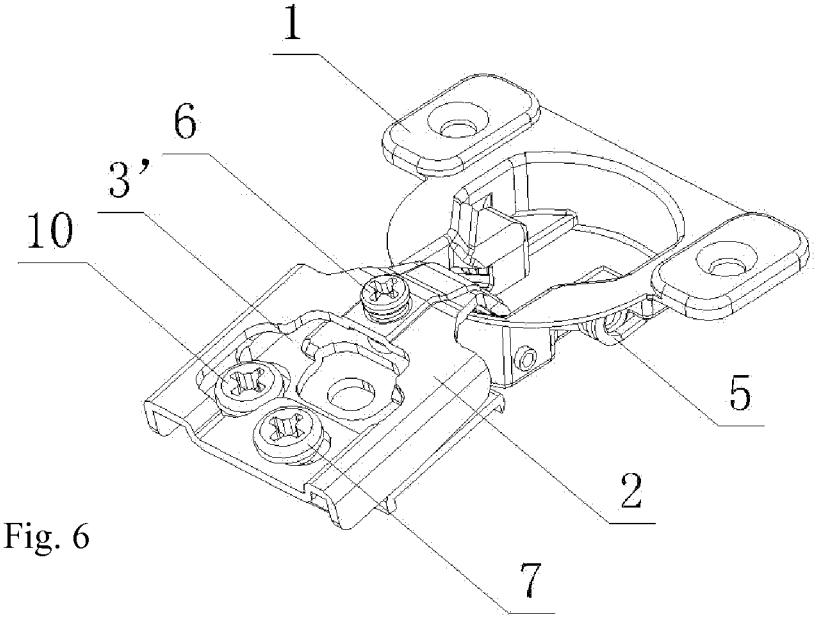
FIGS. 6-7 are three-dimensional structure diagram of the rotary arm in the first embodiment of the present utility model.
Figure 7:
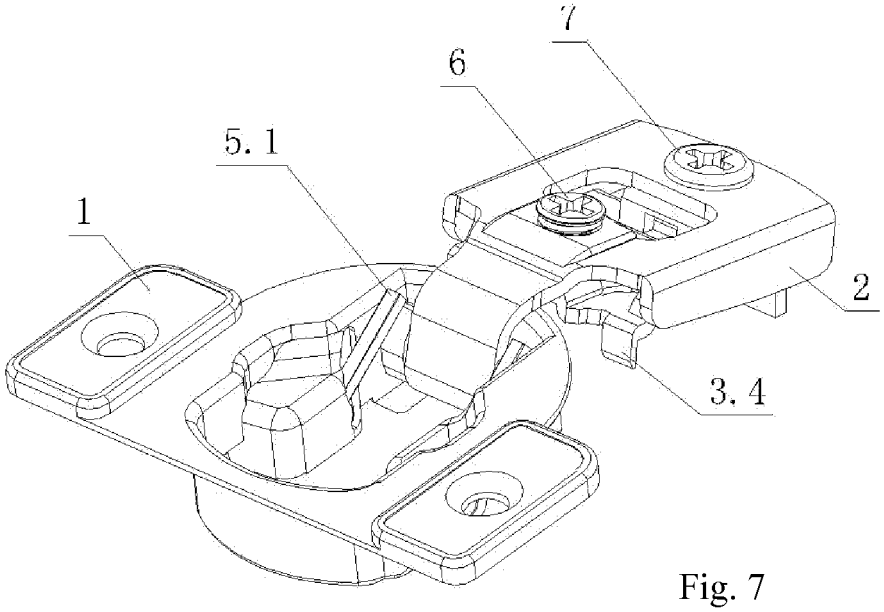
Figure 8:
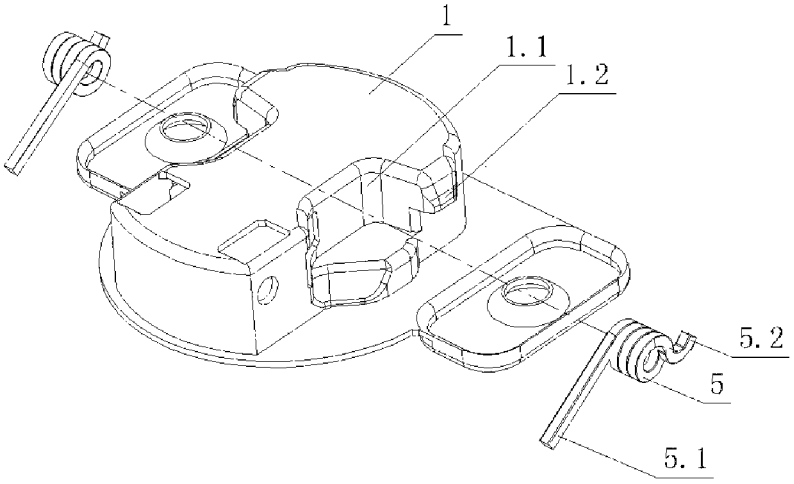
FIG. 8 is the three-dimensional structure diagram of the movable plate in the first embodiment of the present utility model.
Figure 9:
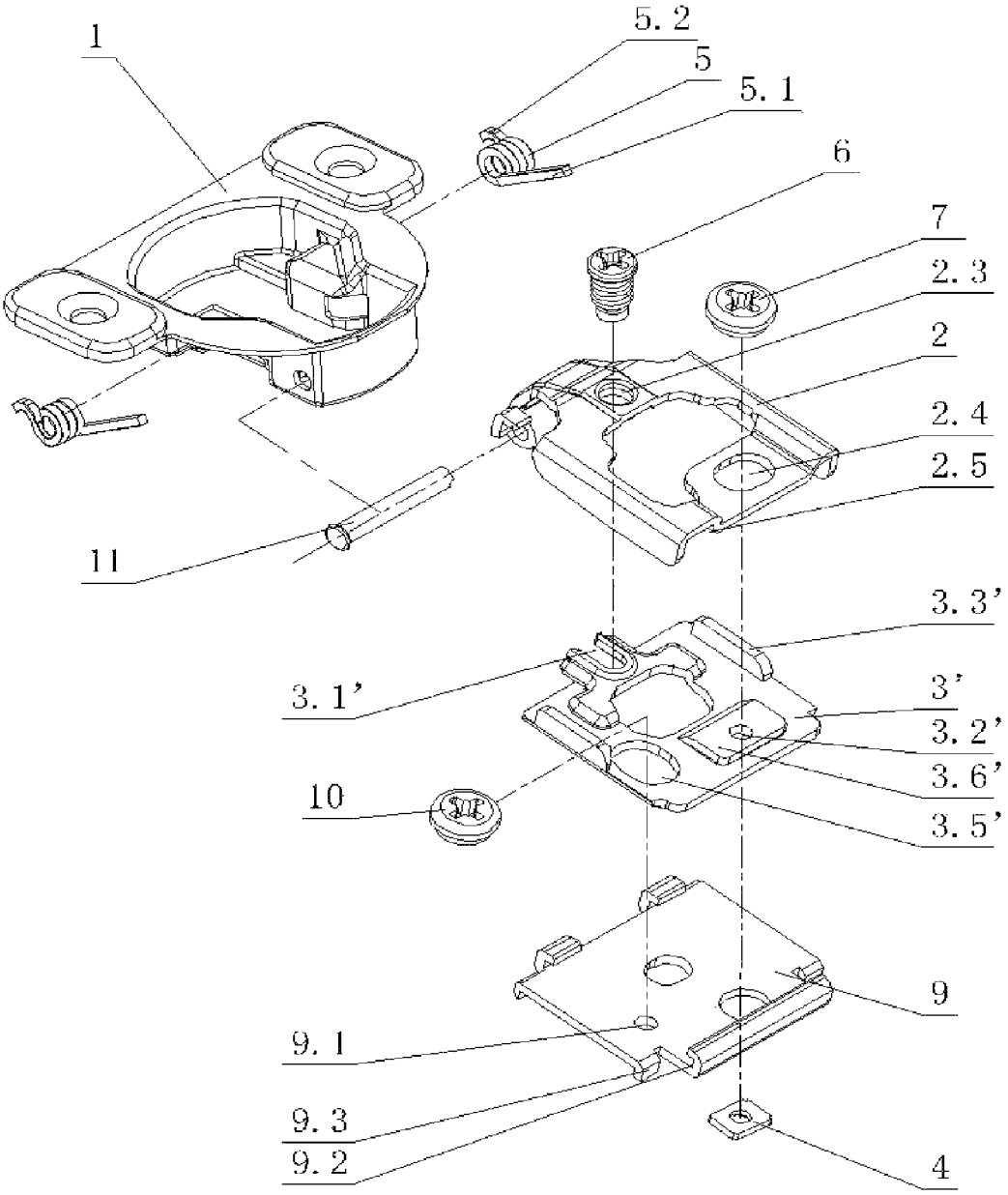
FIG. 9 is the assembly structure diagram of the first embodiment of the present utility model.

As shown in FIGS. 6-7, both sides of the rotary arm 2 are bent downwards to form a groove 2.5; both sides of the movable plate 3' are correspondingly bent upwards to form a strip-type convex part 3.3', which is assembled in the groove 2.5; the movable plate 3' has a certain working space in the groove 2.5 to facilitate the movement in the adjustment process; a guide slot 9.2 used to limit the backward/forward movement of the movable plate 3' is provided at the front and/or rear end of the base plate 9, the front and rear ends of the movable plate 3 is slideably placed in the guide slot 9.2 to play the guiding function for the left/right movement of the movable plate 3' in addition to limiting the forward/backward movement of the movable plate 3'.

As shown in FIGS. 2-5, the step 1.2 and the movable cup holder 1 are integrally formed through stamping; the step 1.2 is so designed that single side is torn, namely the step 1.2 and the movable cup holder 1 are mutually connected through 3 sides, and a through hole is formed on one torn side. The elastic element is composed of two torsion springs 5 in mirror symmetry, which are respectively mounted in the sags 1.1 on both sides at the bottom of movable cup holder 1; a straight end 5.1 and a bent end 5.2 are provided on the torsion spring, wherein the straight end 5.1 extends into the cup body of the movable cup holder 1 and is elastically pressed on the arc-shaped surfaces 2.1 on the rotary arm 2; the bent end 5.2 is supported on the step 1.2, and the end part is inserted into the step 1.2.

One end of the rotary arm 2 extends into the cup body of the movable cup holder 1 and is rotatablely connected with the movable cup holder 1 through a pin shaft 11; arc-shaped surfaces 2.1 are provided on both sides of the end where the rotary arm 2 extends into the cup body 1 of the movable cup holder.

The Second Embodiment

Figure 10:
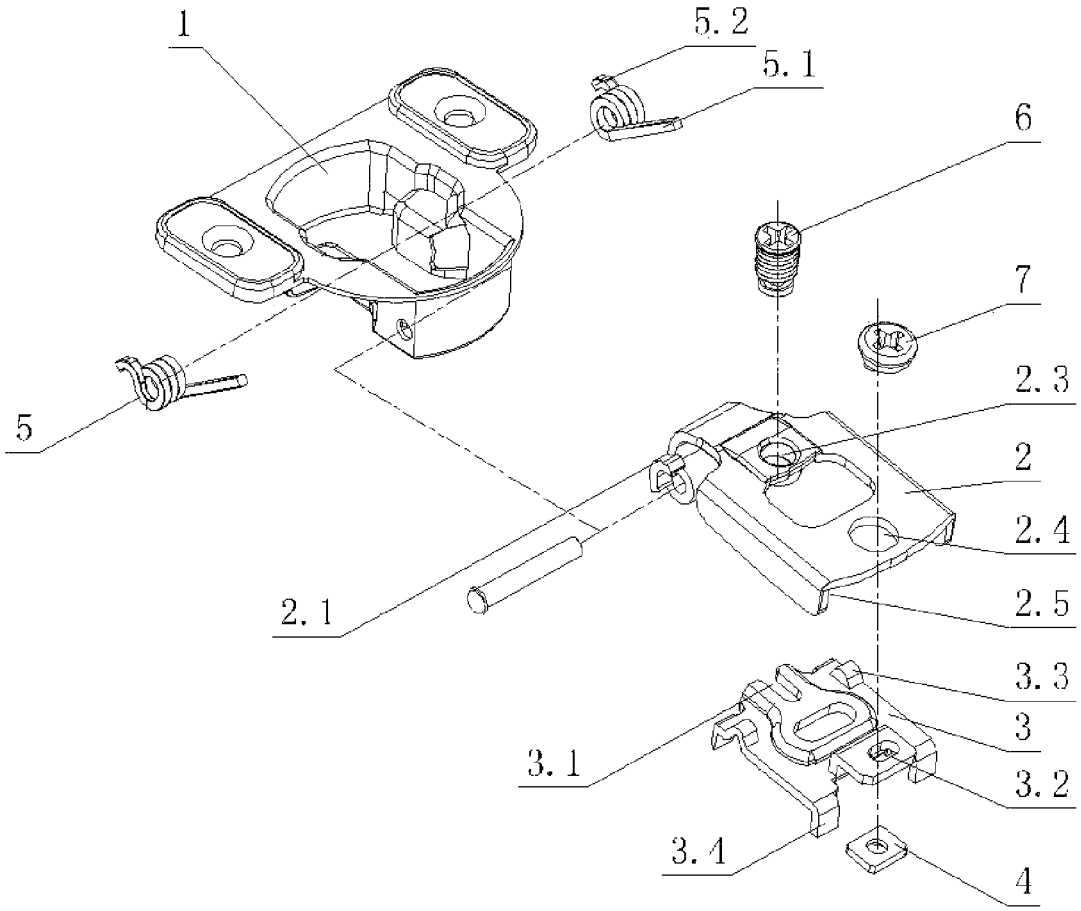
FIG. 10 is the breakdown drawing of the second embodiment of the present utility model.

As shown in FIG. 10, the blind hinge structure used for furniture differs from the first embodiment in the following aspects: the adjusting base is designed to realize two-dimensional adjustment to the hinge, and the adjusting base comprises a rotary arm 2 and a movable plate 3; the rotary arm 2 and the movable plate 3 are connected through the adjusting screw 6 and the first eccentric adjustment rivet 7. The adjusting screw 6 passes through a first adjusting hole 2.3 with thread on the rotary arm 2 and is buckled in an open slot 3.1 on the movable plate 3; it is feasible to adjust the spacing between the rotary arm 2 and the movable plate 3 by rotating the adjusting screw 6, so as to realize the overall height adjustment; the first eccentric adjustment rivet 7 passes through the second adjusting hole 2.4 on the rotary arm 2 and is assembled on the capsule-shaped assembly hole 3.2 on the movable plate 3; a fixed part 4 is also provided at the bottom of the movable plate 3 and is positioned in coordination with the first eccentric adjustment rivet 7. Under the action of the eccentric characteristic of the first eccentric adjustment rivet 7, it is feasible to adjust the forward/backward movement of the rotary arm 2 relative to the movable plate 3 by rotating the first eccentric adjustment rivet 7.

The specific structure: both sides of the rotary arm 2 are bent downwards to form a groove 2.5; two convex parts 3.3 are provided on the movable plate 3 and are assembled in coordination in the groove 2.5; the movable plate 3 has a certain working space in the groove 2.5 and provides the space required for movement adjustment; two corners at front/rear end of the movable plate 3 are bent downwards to form a claw 3.4, so that its connection with the furniture body become even firm and reliable.

The other unmentioned parts are same as those in the first embodiment, so it is no longer necessary to make analysis and description on these parts.

The preferred embodiments of the present utility model are described above. All the simple modifications or transformations made by those skilled in the art to these embodiments fall within the claims of the present utility model.

The invention claimed is:

1. A blind hinge structure used for furniture, comprising:

a movable cup holder provided on the furniture door body, an adjusting base provided on the furniture body, the adjusting base comprising a rotary arm rotatably connected to the movable cup holder, at least one elastic element that generates opening/closing acting force on the movable cup holder by engaging the movable cup holder with a bent end of the elastic element and engaging the rotary arm with a straight end of the at least one elastic element;

wherein the adjusting base further comprises a movable plate and a base plate, the movable plate is movably provided between the rotary arm and the base plate, the rotary arm is connected with the movable plate through an adjusting screw and a first eccentric adjustment rivet, and the movable plate is connected with the base plate through a second eccentric adjustment rivet, so that two or three-dimensional adjustment relative to the furniture door body is realized;

wherein at least one convex step used to support the bent end of one of the at least one elastic members is integrally formed on the bottom walls on one or both sides of the movable cup holder; the at least one elastic member is a torsion spring, with its section on at least one of its end parts being square or circular;

wherein the adjusting screw, the first eccentric adjustment rivet and the second eccentric adjustment rivet are arranged in triangle form on the whole; the adjusting screw passes through a first adjusting hole on the rotary arm and is buckled in an open slot on the movable plate; the first eccentric adjustment rivet passes through a second adjusting hole on the rotary arm and is assembled in an assembly hole on the movable plate; the second eccentric adjustment rivet passes through a third adjusting hole on the movable plate and is assembled on a mating hole on the base plate; a fixed plate is provided at the bottom of the base plate and is configured to engage with at least one of the first eccentric adjustment rivet and the second eccentric adjustment rivet.

2. The blind hinge structure used for furniture of claim 1, wherein both sides of the rotary arm are bent downwards to form a groove, both sides of the movable plate are correspondingly bent upwards to form a strip-type convex part and are assembled in the groove, and the movable plate has a certain working space in the groove; a guide slot used to limit the backward/forward movement of the movable plate is provided at the front end and/or rear end of the base plate; at least one of the front end and rear end of the movable plate is slideably placed in the guide slot.

3. The blind hinge structure used for furniture of claim 1, wherein both sides of the rotary arm are bent downwards to form grooves, both sides of the movable plate are correspondingly bent upwards to form strip-type convex parts and are assembled in the grooves; the movable plate has a certain working space in the groove; two corners at at least one of the front end and rear end of the movable plate are bent downwards to form a claw.

4. The blind hinge structure used for furniture as disclosed in claim 1 wherein the at least one step and the movable cup holder are integrally formed through stamping; the at least one step is so designed that the at least one step and the movable cup holder are mutually connected through three sides, leaving a hole between the movable cup holder and the at least one step, or are mutually connected through four sides leaving no hole between the movable cup holder and the at least one step.

5. The blind hinge structure used for furniture of claim 4, further comprising two torsion springs in mirror symmetry, which are respectively mounted in sags on both sides at the bottom of movable cup holder; a straight end and a bent end are provided on the torsion spring, wherein the straight end extends into the cup body of the movable cup holder and is elastically pressed on the rotary arm; the bent end is inserted into the hole between the movable cup holder and the at least one step or is supported on the sides of the at least one step when the at least one step and the movable cup holder are mutually connected through four sides.

6. The blind hinge structure used for furniture of claim 5, wherein one end of the rotary arm extends into the cup body of the movable cup holder and is rotatable connected with the movable cup holder through a pin shaft; arc-shaped surfaces are provided on both sides of the end where the rotary arm extends into the cup body of the movable cup holder, and the straight end of the torsion spring abuts on the arc-shaped surfaces.

* * * * *